US007377476B2

(12) United States Patent
Almond et al.

(10) Patent No.: US 7,377,476 B2
(45) Date of Patent: May 27, 2008

(54) PORTABLE WATERCOLOR EASEL

(76) Inventors: William Chase Almond, 10300 FM 1187, Ft. Worth, TX (US) 76126; Eric Iain Michaels, 10300 FM 1187, Ft. Worth, TX (US) 76126

( * ) Notice: Subject to any disclaimer, the term of this patent is extended or adjusted under 35 U.S.C. 154(b) by 120 days.

(21) Appl. No.: 11/339,281

(22) Filed: Jan. 25, 2006

(65) Prior Publication Data

US 2007/0170340 A1 Jul. 26, 2007

(51) Int. Cl.
*A47B 97/04* (2006.01)

(52) U.S. Cl. ..... 248/448; 248/449; 248/460; 248/463

(58) Field of Classification Search ..... 248/444.1, 248/447.2, 448, 449, 450, 451, 453, 460, 248/462, 463, 464; 312/231
See application file for complete search history.

(56) References Cited

U.S. PATENT DOCUMENTS 3,202,471 A * 8/1965 Wilson ..... 312/231
3,476,456 A * 11/1969 Canavan ..... 312/231
3,580,653 A 5/1971 Thomas
3,738,606 A 6/1973 Millen
4,318,471 A 3/1982 Hutton
4,372,630 A * 2/1983 Fuhri ..... 312/231
4,699,346 A 10/1987 Bahm
5,655,651 A 8/1997 Maier
5,833,201 A * 11/1998 Graybill ..... 248/462
5,855,329 A * 1/1999 Pagano ..... 248/451
5,979,856 A * 11/1999 Hsu ..... 248/441.1
6,745,988 B2 * 6/2004 Gelfand ..... 248/460
6,772,987 B2 8/2004 Jones
7,118,084 B2 * 10/2006 Park ..... 248/460

* cited by examiner

*Primary Examiner*—Amy J. Sterling
(74) *Attorney, Agent, or Firm*—James E. Walton

(57) ABSTRACT

A lightweight, portable easel designed for use with a standard photographic tripod as a means for painting on location. The easel is equipped with an angled retaining ledge, a retractable brush holder mounted on the left and right side for easy access, a retractable hook for suspending a container, and a base mount for connection to a tripod. By utilizing the angle adjustments of the tripod, the work surface can be adjusted to the preferred angle of the user.

9 Claims, 4 Drawing Sheets

PORTABLE WATERCOLOR EASEL

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

A portable easel designed for painting with watercolors "on location" where the need for a portable, lightweight easel has distinct advantages over other watercolor easels.

2. Description of the Prior Art

The activity of painting outside on location ("en plein air" [to paint from life]) has become increasingly popular. Although there are portable easels specifically available for other mediums, such as oil paints, acrylic paints and pastels, there is nothing that meets all the specifications of our invention for painting watercolors. One of the requirements unique to watercolor painting is a source of fresh water for mixing paints and cleaning brushes. It is also often necessary to tilt the watercolor forward, backward or from side to side to accomplish a technique called a "wash."

Another requirement of watercolor painting on location is a stable work surface. Other types of available easels, while being relatively stable, are heavy to transport and complex to set up.

The Collapsible Flow Control Easel in U.S. Pat. No. 4,699,346 to Bahm, 1987 Oct. 13, does not have a bottom ledge for stabilizing the work (watercolor block or board). Furthermore, this easel does not have a retractable watercolor brush holder, or a retractable hook for a water container.

The Artist's Painting Kit and Tripod Adapter in U.S. Pat. No. 3,580,653 to Thomas, 1971 May 25, has a hook for a water container that is located on the side of the paint box, which can affect the easel's balance. The hook is not retractable for both compactness and portability. Moreover, the easel has no retractable brush holder or a retaining ledge to support the work. It is also comprised of many parts and needs many adjustments to use, limiting its portability and ease of use.

The Work Holder in U.S. Pat. No. 3,738,606 to Millen, 1973 Jun. 12, when adjusted to the horizontal position required in painting watercolors, would throw the Work Holder off balance and therefore, would become unstable. Moreover, it has no retractable hook for a water container or a retractable brush holder.

The brush holder in the Portable Easel Assembly in U.S. Pat. No. 6,722,987 to Jones, 2004 Aug. 10, pivots on a centerpoint and has no positive stop and therefore can be moved or damaged at any time. Moreover, the holes in the brush holder are not positioned in an increasing or decreasing size order, making brush selection more difficult. This easel has no retractable hook to provide water container placement. Furthermore, if during the process of painting a watercolor wash the need to tilt the easel to the left or right is required, it can't be done with this easel, which only tilts forward and backward. In addition, the retractable legs are difficult to set up and fold back.

The Palette and Easel Assembly in U.S. Pat. No. 5,655,651 to Maier, Aug. 12, 1997, is designed for attachment to a photographic tripod; however, it has no watercolor brush holders or hook for a water container. The palette extends from the work surface towards the artist, hindering the artist's arm movement when painting on the lower portion of the work surface. Furthermore, it is also comprised of many parts and needs many adjustments to change the work angle, limiting its ease of use.

The Artist's Lap Easel in U.S. Pat. No. 4,318,471 to Hutton, Mar. 9, 1982 does not provide for mounting on a photographic tripod, and has no hook for a water container. Furthermore, although it provides storage for pencils and brushes, there is no provision for having wet brushes at the ready.

Accordingly there is a need for an improved watercolor easel that is lightweight, portable, holds the artist's watercolor brushes, water container and at the same time allows the artist to adjust the angle of the work surface while executing a wash through manipulating the attached tripod. There is also a need for an easel that offers no obstruction, such as a drawer, palette or other appendage, between the artist's hand and the work surface, so that he or she can freely brush on the paint.

The present invention fulfills these needs and provides other related advantages. Further objects of the invention will become apparent from consideration of the drawing and ensuing description. Accordingly, besides the objects and advantages of the portable watercolor easel described in our patent, several objects and advantages of the present invention are:

(a) to provide an easel that is lightweight and portable for painting outside at any location;
(b) to provide an easel that has an angled ledge that holds the work;
(c) to provide an easel that can easily be mounted to a lightweight photographic tripod;
(d) to provide an easel that when attached to a photographic tripod, can easily be tilted in order to move the work surface forward, backward, left or right;
(e) to provide an easel that has retractable brush holders for easy brush access and storage of the easel;
(f) to provide an easel where the brush holders are mounted on the left and right side for use by left or right-handed people;
(g) to provide an easel that is equipped with an attached L-shaped retractable sliding hook for suspending a water container and for easy storage of the easel; and
(h) to provide an easel where the water container can easily be attached, making water convenient to the painter, the container is located in a position that balances the easel, and is designed with a hook to minimize water container movement.

SUMMARY OF THE INVENTION

The present invention provides a portable easel that includes a rigid generally parallelogram work surface having sufficient size to accommodate a panel used in watercolor painting by a human being. Located along one edge of the work surface is attached an angled ledge which stabilizes the panel and can also be used as a stop when lifting the work to control the flow of a wash while painting. The work surface also includes a base or mounting plate with a female adapter and cork mounting gasket joined to the underside, or side opposite the panel support side, as a means for attaching the plate to a photographic tripod. The advantages of using a photographic tripod with this easel are that photographic tripods are lightweight, easy to set up on any surface, and when used in conjunction with the easel, make it easy to tilt the angle of the work surface forward, backward, left or right, which is necessary for executing a watercolor wash.

The easel also uses a flat, rectangular, retractable sliding plate, having a plurality of precision holes, joined to the underside of the work surface, as a means for holding watercolor brushes. In addition to the afore-mentioned sliding plate brush holder, there is an L-shaped retractable sliding hook device attached to the underside of the work surface opposite the ledge as a means for suspending a water container. The hook is of sufficient width to stabilize the swiveling movements of the water container by making contact with the handle at a plurality of points and to maximize overall balance.

These and other features of the invention, together with the elements of a preferred embodiment will become clear from the following disclosure, and the appended claims.

DESCRIPTION OF THE DRAWINGS

An understanding of the invention will become apparent upon consideration of the following detailed description, taken in connection with the accompanying drawings, wherein.

DRAWINGS—REFERENCE NUMBERS

Figure 1:
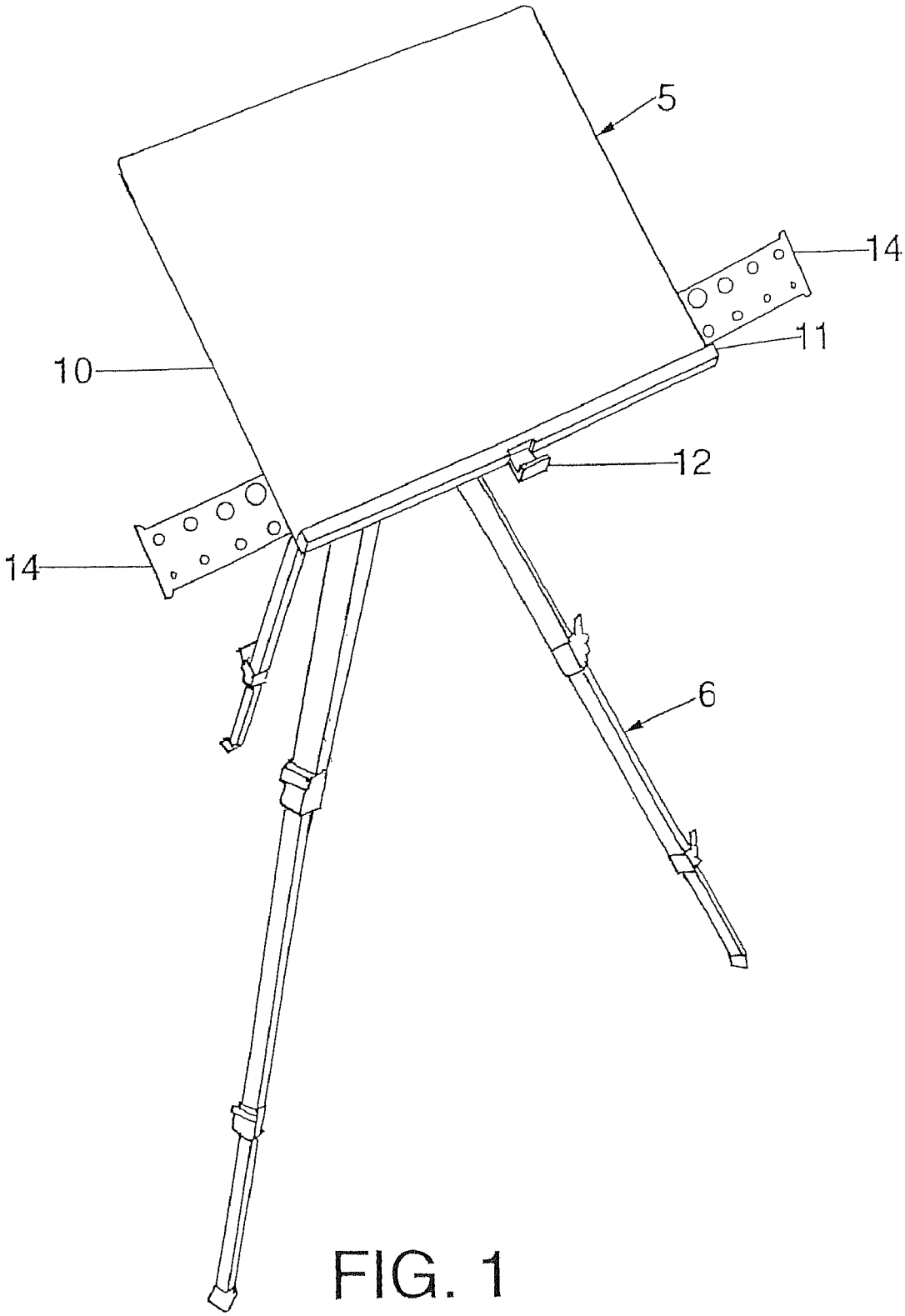
FIG. 1 is a perspective view of the easel of the present invention with all appendages extended and ready for use.

5 easel
6 photographic tripod
10 work surface
11 angled retaining ledge
12 retractable hook
13 retractable hook retaining channel
14 retractable brush holder
15 retractable brush holder retaining channel base mount
16 mounting gasket
17 threaded female adapter

DETAILED DESCRIPTION OF THE PREFERRED EMBODIMENTS

Referring now to the drawing, there is shown in FIG. 1 a portable watercolor easel embodying the present invention. The easel 5 is illustrated as mounted on a standard photographic tripod 6 having extendible or telescopic legs. The easel 5 is movable between a flat collapsed position and an erect extended position mounted on tripod 6 for use outdoors at the painting site.

As illustrated, the easel 5 comprises a work surface 10 comprising a parallelogram, generally flat rigid panel supporting surface with the edges perpendicular to each other. The preferred material for the construction of the easel is a hard plastic such as ABS polymetic material, polycarbonate, PVC foam sheet, or shatter-resistant acrylic. Other suitable materials are injected molded styrene, structural foam, cast urethane, plywood and sheet metal.

Figure 2:
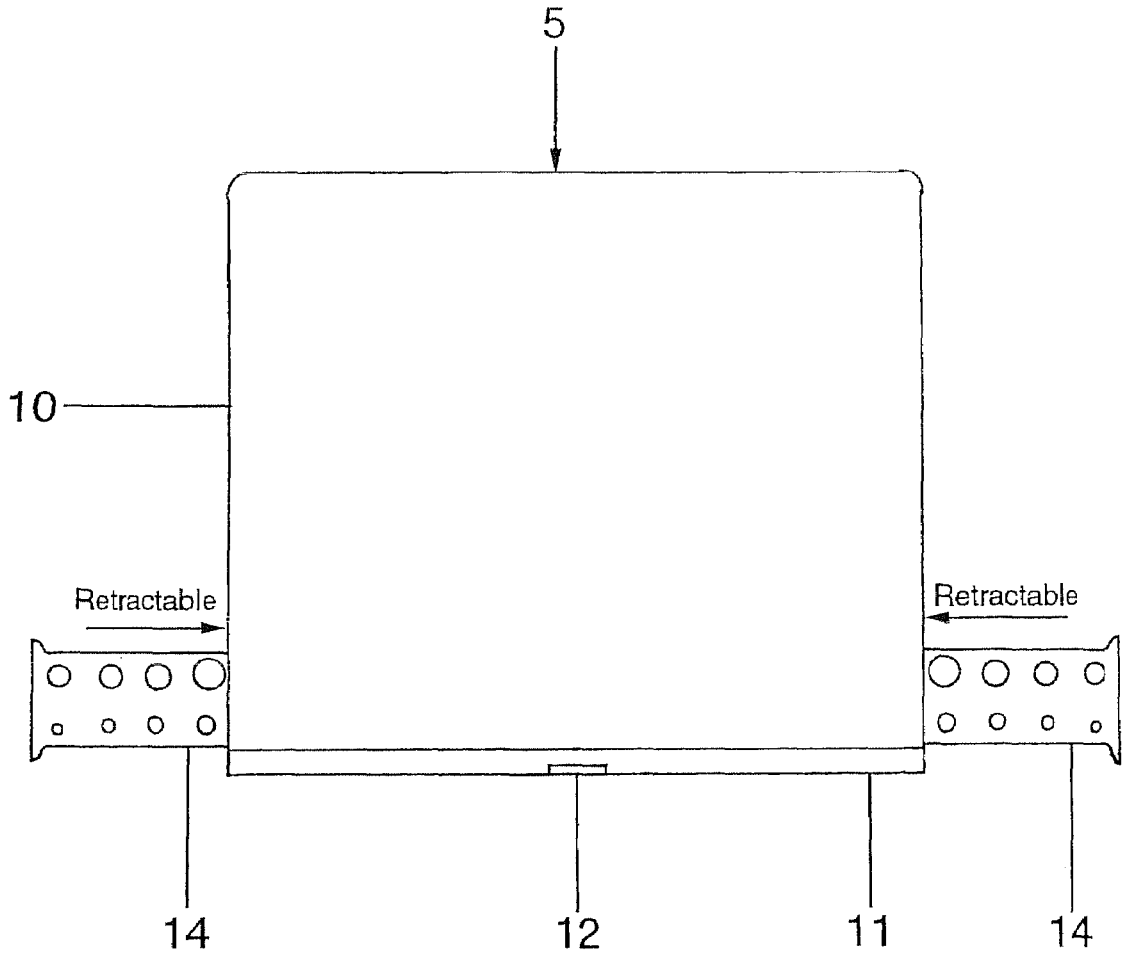
FIG. 2 is a front view (plan) indicating the retractable features of the easel.

Along one edge of the work surface 10 is an angled or beveled body forming a work retaining ledge 11. The retaining ledge has a side adjacent the panel support surface which makes a face at an angle with the support surface less than 90 degrees. The retaining ledge 11 extends generally the length of the one edge. Mounted symmetrically along the one edge and on side of the work surface opposite the retaining ledge 11 is a hook member 12, which is retractable from a storage position, which is shown in FIG. 2, to the extended position shown in FIG. 1 perpendicular to the length of the ledge 11. The retractable hook 12 is appended to the side of the work surface opposite the ledge 11 by a retaining channel 13. The hook member 12 has retaining projections on one end and the formed leg on the other that restrict its movement. The retractable hook member 12 is designed to hold or suspend the bail of a water reservoir, a pail, bag, can or cup. The L-shaped hook member 12 affords a member of sufficient width to make contact with the water container handle or bail in a plurality of locations to stabilize the water reservoir and balance the easel.

Figure 3:
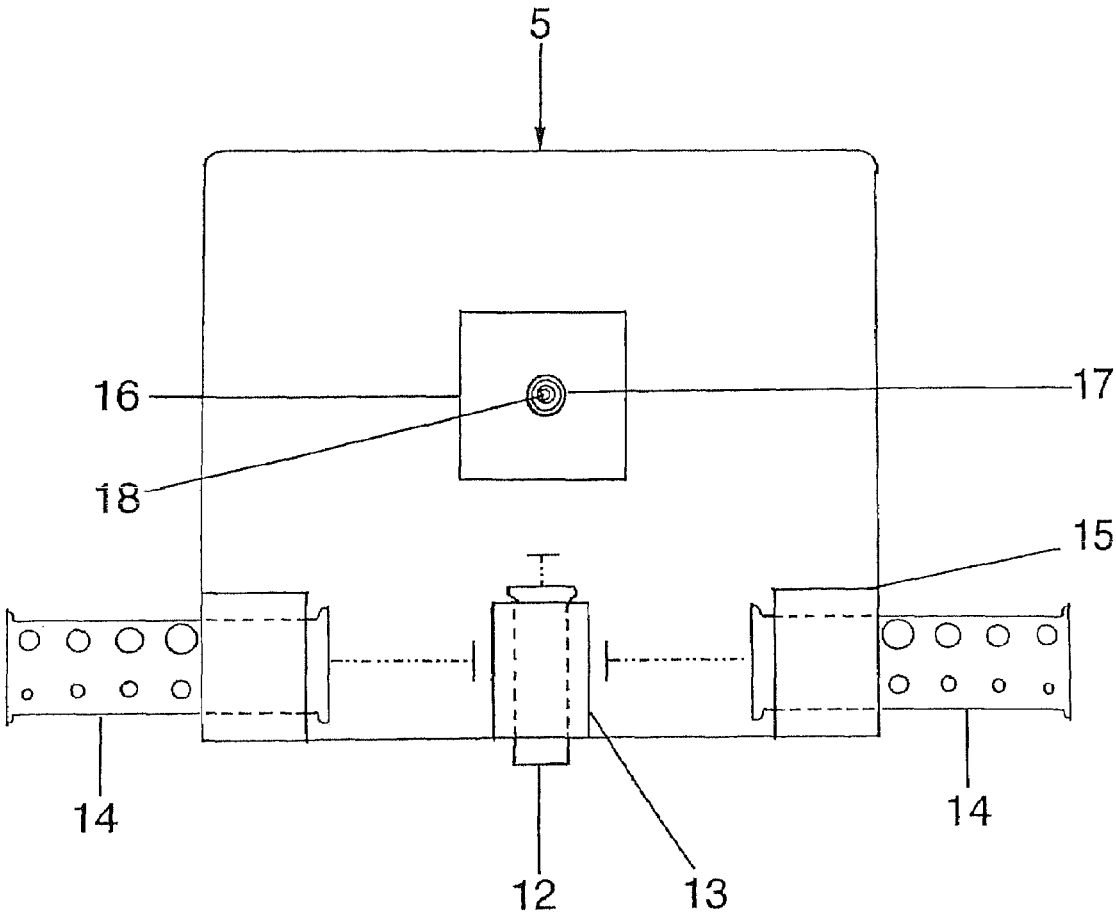
FIG. 3 is a rear plan view showing the base and retractable features.
Figure 4:
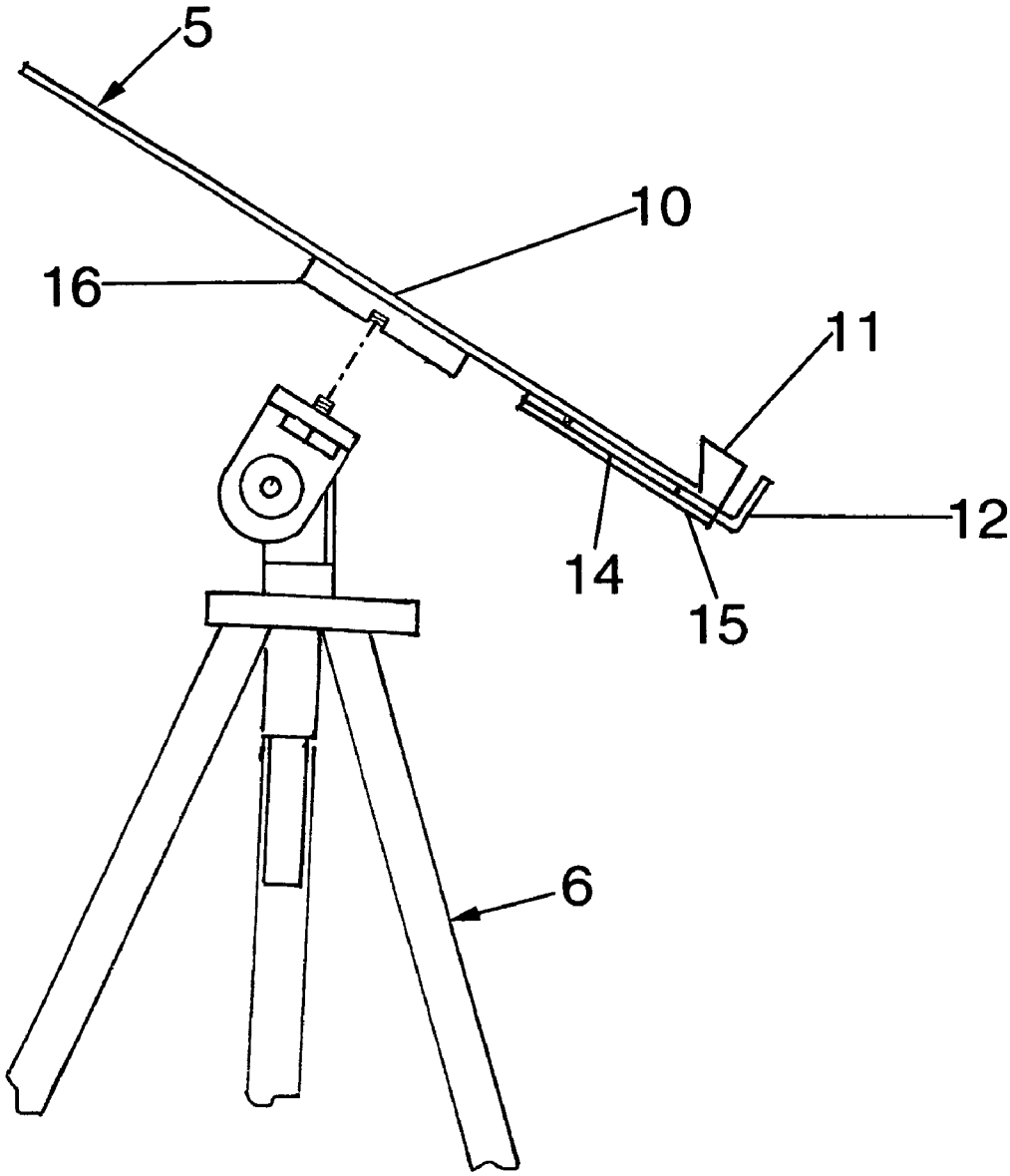
FIG. 4 is a side view indicating how the invention is attached to a photographic tripod.

Watercolor brush holders 14 are mounted on opposite edges of the work surface 10 and are movable between an extended position as illustrated in FIGS. 1 and 2, and a retracted position as illustrated by dotted lines in FIG. 3. The brush holders 14 are each configured with precision holes, generally eight, to accommodate the handles of the watercolor brushes. They are appended by means of retainers to one side of the support work surface 10, opposite the side used to support a panel. As illustrated, they are supported by rectangular channels 15 supported on the side of the support surface and the channels are of a size to support the brush holders 14 to allow the same to slide from a retracted transport position to the extended use position of FIGS. 1 and 2. The brush holders 14 are formed with retainer ledges or projections at each end to retain the brush holders in the channels 15 to restrict movement and prevent loss. The channels 15 can be formed of unshaped members or from three pieces to define the channels of a width and thickness to support and permit sliding of the brush holders 14.

As illustrated in FIG. 3, a base mounting plate 16 is attached to one side of the rigid work surface 10 to attach the watercolor easel 5 to a standard photographic tripod 6. Base mounting plate 16 incorporates a threaded female adapter 18 and a gasket 17 formed of cork or rubber. The gasket 17 will ensure a snug and secure fit to the standard photographic tripod 6. Base mounting plate 16 is positioned and attached symmetrically to provide maximum balance and offset the weight of said ledge 11 and the appendages 12 and 14 mounted on one side.

The invention claimed is:

1. A portable easel for watercolor painting, comprising:

(a) a rigid work surface having a size to accommodate a panel for watercolor painting, (b) base mounting plate means joined to one side of said rigid work surface for attaching said work surface to a photographic tripod, (c) flat, rectangular retractable sliding plate means having a plurality of holes joined to said one side of said rigid work surface for holding brushes in their extended position, (d) retractable sliding hook means being joined to said one side for suspending a container, and (e) a ledge being joined to one edge of said rigid work surface opposite said one side for stabilizing a said panel whereby a human can paint conveniently on location, wherein said retractable sliding plate means comprises a first and a second sliding plate affixed along opposite edges of said work surface for sliding movement toward and away from each other and parallel to said ledge.

2. A portable easel for watercolor painting, comprising:

(a) a rigid work surface having a size to accommodate a panel for watercolor painting, (b) base mounting plate means joined to one side of said rigid work surface for attaching said work surface to a photographic tripod, (c) flat, rectangular retractable sliding plate means having a plurality of holes joined to said one side of said rigid work surface for holding brushes in their extended position, (d) retractable sliding hook means being joined to said one side for suspending a container, and (e) a ledge being joined to one edge of said rigid work surface opposite said one side for stabilizing a said panel whereby a human can paint conveniently on location, wherein hook means is attached to said one side of said work surface for movement perpendicular to said ledge.

3. A portable easel according to claim 1 wherein said first and second sliding plates have retaining means at each end of each plate for forming positive stops.

4. A portable easel according to claim 1 wherein said sliding plate means are held in place by a retainer channel attached to said one side of said work surface.

5. A portable easel according to claim 1 wherein said sliding plate means have precision holes to specifically accommodate standard size watercolor brushes.

6. A portable easel according to claim 1 wherein each sliding plate has eight precision holes to accommodate different standard size watercolor brushes.

7. A portable easel according to claim 2 wherein said hook means comprises a plate supported by a channel member for sliding movement and has retaining ledges on one end and an L-shape at the opposite end.

8. A portable easel according to claim 4 wherein said retainer channels are positioned along opposite edges of said work surface near said ledge.

9. A portable easel according to claim 7 wherein said L-shape end of said hook member is abutting said ledge in the retracted position.

* * * * *